US009927774B2

(12) United States Patent
Rotbergs

(10) Patent No.: US 9,927,774 B2
(45) Date of Patent: Mar. 27, 2018

(54) PILL DISPENSING WATCH

(71) Applicant: Rebecca Rotbergs, Miranda, CA (US)

(72) Inventor: Rebecca Rotbergs, Miranda, CA (US)

(73) Assignee: Rebecca Rotbergs, Miranda, CA (US)

( * ) Notice: Subject to any disclaimer, the term of this patent is extended or adjusted under 35 U.S.C. 154(b) by 149 days.

(21) Appl. No.: 14/999,621

(22) Filed: Jun. 6, 2016

(65) Prior Publication Data

US 2017/0351220 A1 Dec. 7, 2017

Related U.S. Application Data

(60) Provisional application No. 62/250,021, filed on Nov. 30, 2015.

(51) Int. Cl.

| | |
|---|---|
| ***G04B 37/12*** | (2006.01) |
| ***B65D 83/04*** | (2006.01) |
| ***A61J 1/03*** | (2006.01) |
| ***A44C 5/00*** | (2006.01) |

(52) U.S. Cl.

CPC ..... *G04B 37/127* (2013.01); *A44C 5/00* (2013.01); *A61J 1/03* (2013.01); *B65D 83/0445* (2013.01)

(58) Field of Classification Search

CPC ..... G04B 37/127
USPC ..... 368/1
See application file for complete search history.

(56) References Cited

U.S. PATENT DOCUMENTS

| | | | | |
|---|---|---|---|---|
| 2,948,106 A * | 8/1960 | Blumstein | G04B 23/12 | 206/216 |
| 3,638,830 A * | 2/1972 | Belokin, Jr. | B65D 83/0409 | 206/533 |
| 3,864,856 A * | 2/1975 | McManus | A44C 5/0015 | 224/165 |
| 4,419,770 A * | 12/1983 | Yagi | G04B 47/025 | 368/10 |
| 4,427,130 A * | 1/1984 | Szigeti | A44C 5/003 | 221/4 |
| 5,802,014 A * | 9/1998 | Danko | A44C 5/003 | 224/165 |
| 2009/0040874 A1* | 2/2009 | Rooney | A61J 7/0472 | 368/10 |

FOREIGN PATENT DOCUMENTS

| | | | | |
|---|---|---|---|---|
| WO | WO-9836726 A1 * | 8/1998 | A61J 7/0481 | |

* cited by examiner

*Primary Examiner* — Jason C Olson
(74) *Attorney, Agent, or Firm* — Rebecca Rotbergs

(57) ABSTRACT

A pill dispensing watch with a wrist watch assembly that includes a housing that encloses a time keeping apparatus as well as a plurality of pill storage drawers and microprocessor controlled electro mechanical drawer extending assemblies that allow the user to set the time for a pill taking event and for the pill retaining drawers to each open at the time the pill needs to be taken. A micro USB port built into the watch housing lets the user plug the on board microprocessor into a standard computer so that the user can program the times that the drawers need to open and an audio alarm needs to sound. In one embodiment the watch housing includes two of the drawers extending from the left side of the watch housing and two drawers extending from the right side of the watch housing.

5 Claims, 5 Drawing Sheets

PILL DISPENSING WATCH

CROSS REFERENCE TO RELATED APPLICATIONS

Provisional patent application 62/250,021 filed Nov. 3, 2015

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of time keeping devices and more specifically to pill dispensing watch.

Wrist watches have been available for use for over one hundred years. In recent years, the need for many people to take medications at specific times has increased dramatically. These same people generally need some sort of reminder device to help them remember when to take the medication, especially if multiple medications need to be taken, or if the medication needs to be taken multiple times per day.

To this end, numerous time keeping devices have been produced and sold that include an alarm feature that can be set for when a medication needs to be taken. For example, David Zarcham, in his U.S. Pat. No. 6,075,755 discloses a watch that can be programmed to tell a person when to take one or more medications. Additionally, A Blumstein, in his U.S. Pat. No. 2,948,106 discloses an analogue watch that includes an alarm feature and a single hollow housing located under the time keeping mechanism that can hold pills.

However, there is a deficiency in the prior technology in that none of the prior designs show a wrist watch that allows a person to store a plurality of medications within the watch housing, each medication pill within its own drawer, and to have those medications automatically dispensed from the extendable and retractable drawers at the proper time for taking the medication.

BRIEF SUMMARY OF THE INVENTION

The primary object of the invention is to provide a wearable wrist watch that can be programmed to let the user know when to take medications.

Another object of the invention is to provide a wrist watch that includes storage drawers for pills.

Another object of the invention is to provide a wrist watch that automatically extends a pill drawer at the time the proper time for taking a medication.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a pill dispensing watch comprising: a wrist watch assembly including a wrist band, a watch housing and a time keeping mechanism, an alarm device and display, a plurality of pill storage drawers, a plurality of electro mechanical drawer extending assemblies, a microprocessor, a battery power supply, a micro USB port, said pill storage drawers slidably mounted within said watch housing and under said watch display, said electro mechanical drawer extending assemblies each mounted adjacent to said pill storage drawer, each said pill storage drawer including a horizontally and outwardly disposed engagement tab, each said engagement tab including an engagement aperture, said electro mechanical drawer extending assembly each including an upwardly directed post for engaging the said aperture in said pill storage drawer tab, said electro mechanical drawer extending assemblies being powered by said battery power supply, said microprocessor capable of being programmed by an external computer via said micro USB port, and said electro mechanical drawer extending assemblies capable of being programmed to open, along with the sounding of an alarm, at the time that the user is to take a specific medication which is housed within said drawer.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
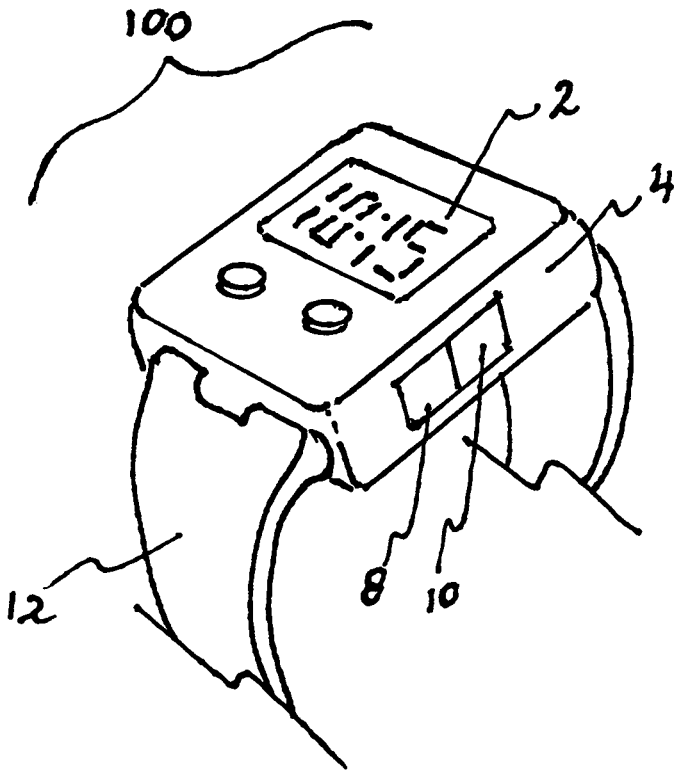
FIG. 1 is a perspective view of the invention.

Referring now to FIG. 1 we see a perspective view of the present invention 100. A typical wrist band 12 retains a watch housing 4. A digital clock display 2 can be seen in its normal location. Two drawer ends 8, 10 can be seen on the side of the housing 4 as well as a micro USB port 6.

Figure 2:
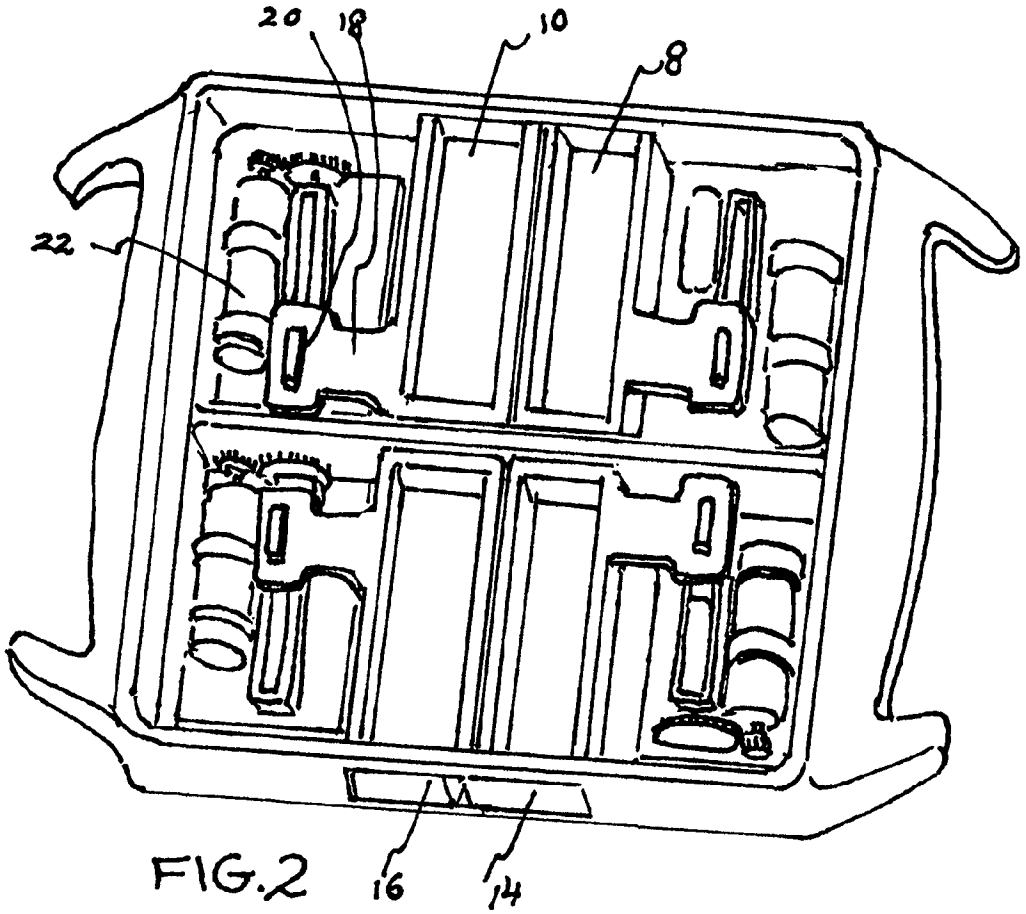
FIG. 2 is a perspective view of the invention with the top time keeping portion removed.

FIG. 2 shows a perspective view of the watch housing 4 and its contents with the time keeping portion removed to reveal drawer members 8, 10, 14, 16. Each drawer member includes a horizontally disposed tab 18. Each tab 18 includes an aperture that is capable of retaining a post 20. Post 20 is part of an electro mechanical servo mechanism 22 that can slide the post forward or backward upon command from a microprocessor 23 shown in FIG. 3. In the present embodiment two drawers 8, 10 can extend from the right side of the watch housing 4 and two drawers 14, 16 can extend from the left side of the watch housing 4.

Figure 3:
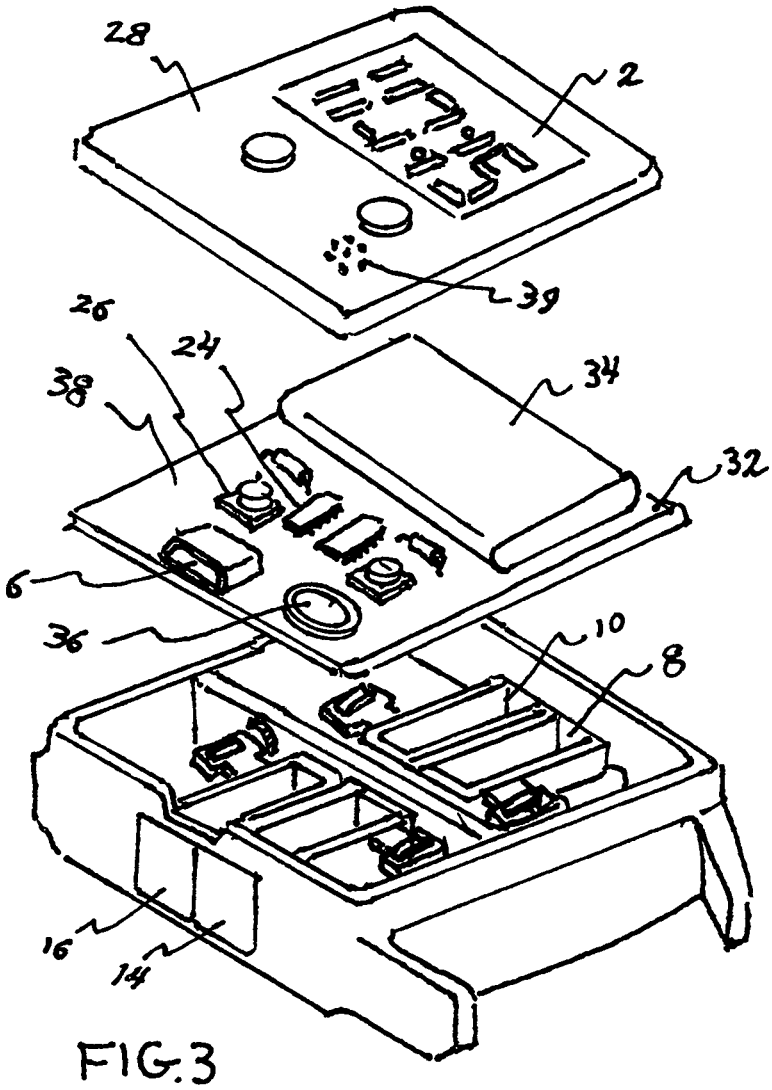
FIG. 3 is an exploded view of the invention.

FIG. 3 is an exploded view of the invention 100. Top panel 28 includes a digital clock display 2 that is mounted directly under the top panel 28. A mid-level panel 32 supports microprocessor electronics 24 as well as battery 34. Micro USB 6 and alarm sounding member 36 are mounted on printed circuit board 38 as well as microprocessor electronics 24. The bottom layer includes the main watch housing 4 drawers 8, 10, 14, 16 and their electro mechanical drive assemblies 22. Apertures 39 in the top cover 28 allow sound from the alarm sounding member 36 to exit and be better heard by the user. In an alternate embodiment, the apertures 38 can be eliminated to improve the water resistance of the watch.

Figure 4:
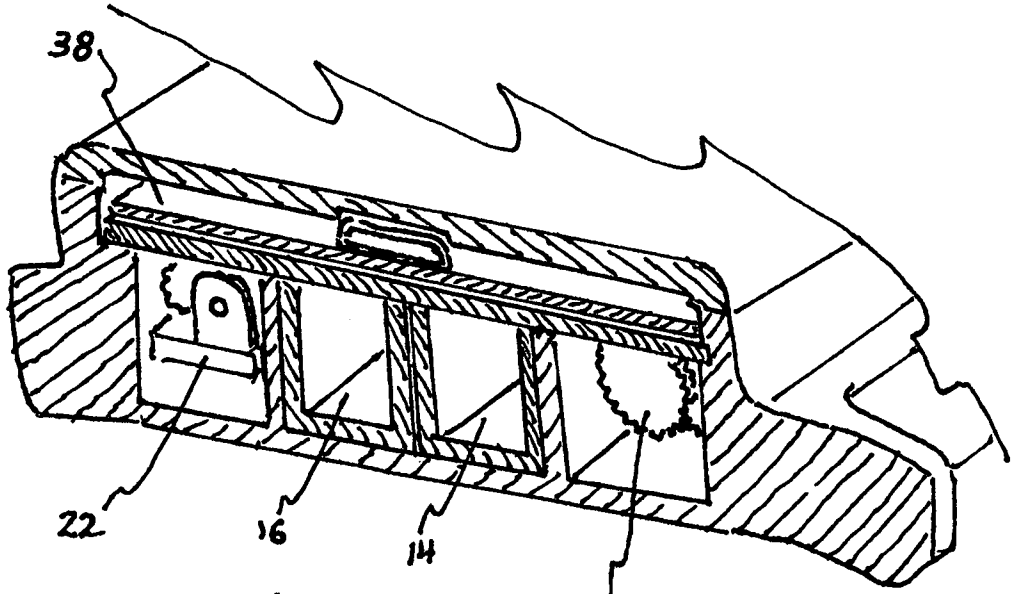
FIG. 4 is a section view of the invention

FIG. 4 is a section view showing the position of drawers 14, 16 and electro mechanical assemblies 22, 22A located under mid panel 32 supports printed circuit board 38.

Figure 5:
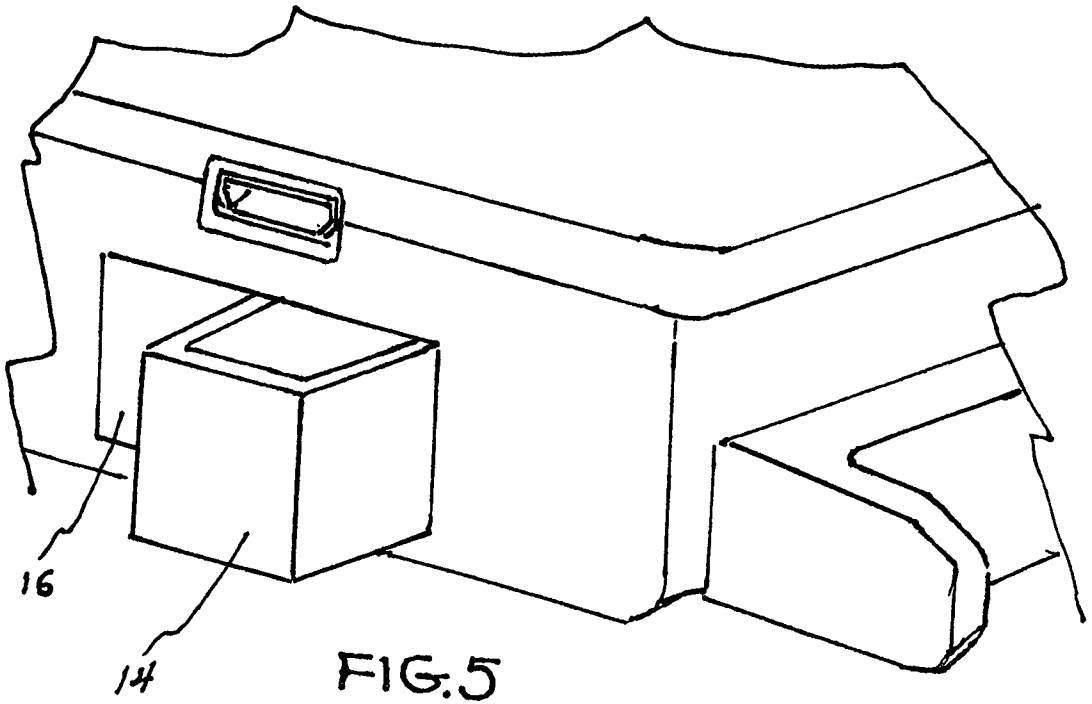
FIG. 5 is a perspective view of the invention with one drawer open.

FIG. 5 is a perspective view of the invention 100 with one drawer 14 extended outward so that a user can remove one pill from the drawer at the proper time.

FIG. 6 is a schematic drawing of the electronic design for the invention.

The watch and pill retaining drawers of the present invention 100 can be programmed by connecting the watch 100 to a computer via the micro USB connector port 6. The user can then be walked through programming instructions which include the filling of the drawers 8, 10, 14, 16 with pills. For this purpose, the drawers can be made to all open in rapid succession and to stay open for a fixed period such as twenty seconds which is enough time to fill the drawers with pills. The drawers can then close in rapid succession so that the watch is ready for use. When the desired pill taking time is reached the alarm sounds, and the corresponding drawer opens to reveal the pill that is to be taken at that time. In the present embodiment, four different drawers can receive four different pills which can be programmed to open at four different times. Other embodiments of the invention can be envisioned having more or less drawers than the design shown here. Additionally, the user can program two or more drawers to open at the same time if two or more pills need to be taken at once.

The above described and illustrated wrist watch with pill drawers included is a great benefit to those who are on the go and who need to be reminded to take their medication and also need the convenience of having the proper medication in very close proximity and dispensed at the proper time While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A pill dispensing watch comprising:

a wrist watch assembly including a wrist band, a watch housing, a time keeping mechanism, a display, and a plurality of drawer assemblies each comprising a pill storage drawer and an electro mechanical drawer extending assembly;

a microprocessor;

a battery power supply;

a micro USB port;

a sound emitting alarm member;

said pill storage drawers slidably mounted within said watch housing and under said watch display;

said electro mechanical drawer extending assemblies each mounted adjacent to each said pill storage drawer;

each said pill storage drawer including a horizontally and outwardly disposed engagement tab; each said engagement tab including an engagement aperture;

said electro mechanical drawer extending assembly each including an upwardly directed post for engaging the said aperture in said pill storage drawer tab;

said electro mechanical drawer extending assemblies being powered by said battery power supply;

said microprocessor capable of being programmed by an external computer via said micro USB port; and wherein said alarm sounding member and said electro mechanical drawer extending assemblies are controlled by said processor;

and said processor controls said electro mechanical drawer extending assemblies to open at a programmed time, thereby enabling medication to be accessed within at least one of said plurality of pill storage drawers.

2. A pill dispensing watch as claimed in claim 1 wherein said watch housing retains four drawer assemblies; two said drawer assemblies capable of extending from the left side of said watch housing and two said drawer assemblies extending from the right side of said watch housing.

3. A pill dispensing watch as claimed in claim 1 wherein said drawer assemblies can be controlled to open all in rapid succession for the purpose of filling said pill dispensing drawers with pills and wherein said drawer assemblies can be controlled to close all in rapid succession.

4. A pill dispensing watch as claimed in claim 1 wherein said watch housing retains three drawer assemblies; two said drawer assemblies capable of extending from a first side of the said watch housing and one said drawer assembly extending from a second side of said watch housing.

5. A pill dispensing watch as claimed in claim 1 wherein said watch housing retains two drawer assemblies; one said drawer assembly capable of extending from a left side of said watch housing and one said drawer assembly extending from a right side of said watch housing.

* * * * *